US008573832B2

(12) United States Patent
Nicoud

(10) Patent No.: US 8,573,832 B2
(45) Date of Patent: Nov. 5, 2013

(54) BARREL FOR A SELF WINDING TIMEPIECE

(75) Inventor: Serge Nicoud, Le Landeron (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 260 days.

(21) Appl. No.: 13/212,764

(22) Filed: Aug. 18, 2011

(65) Prior Publication Data

US 2012/0044789 A1 Feb. 23, 2012

(30) Foreign Application Priority Data

Aug. 19, 2010 (EP) ..... 10173354

(51) Int. Cl.

| | |
|---|---|
| ***G04B 1/16*** | (2006.01) |
| ***G04B 1/18*** | (2006.01) |
| ***G04B 5/02*** | (2006.01) |
| ***B04B 5/02*** | (2006.01) |

(52) U.S. Cl.

CPC .. *G04B 1/16* (2013.01); *G04B 1/18* (2013.01); *B04B 5/02* (2013.01)

USPC ..... 368/140; 368/144; 368/148

(58) Field of Classification Search

USPC ..... 368/139–140, 142, 144, 148, 207, 208

See application file for complete search history.

(56) References Cited

U.S. PATENT DOCUMENTS

| | | | | | |
|---|---|---|---|---|---|
| 137,437 | A | * | 4/1873 | Bove | 368/144 |
| 385,908 | A | * | 7/1888 | Church | 368/144 |
| 1,522,073 | A | * | 1/1925 | Odom | 185/45 |
| 1,677,045 | A | * | 7/1928 | Odom | 185/45 |
| 3,621,650 | A | * | 11/1971 | Schnyder et al. | 368/144 |

FOREIGN PATENT DOCUMENTS

| | | |
|---|---|---|
| CH | 280 369 A | 4/1952 |
| DE | 12 52 591 B | 10/1967 |

* cited by examiner

*Primary Examiner* — Vit W Miska

(74) *Attorney, Agent, or Firm* — Sughrue Mion, PLLC

(57) ABSTRACT

Barrel for a self-winding timepiece including a drum of axis AA provided with an internal lateral wall having friction surfaces alternating with locking structures forming salient or inward edges at the boundary of the friction surfaces and a mainspring forming a winding including an outer coil, which is friction coupled to said internal lateral wall and free to slip against said internal lateral wall in the event of overwinding of the mainspring, characterized in that said friction surfaces are demarcated, downstream relative to the direction in which said outer coil slips, by a rounded salient edge or an inward edge.

6 Claims, 1 Drawing Sheet

BARREL FOR A SELF WINDING TIMEPIECE

This application claims priority from European Patent Application No. 10173354.1 filed Aug. 19, 2010, the entire disclosure of which is incorporated herein by reference.

FIELD OF THE INVENTION

The present invention relates to the field of watch making. It concerns, more specifically, a barrel, intended to be fitted to a self-winding timepiece. The invention also concerns a timepiece fitted with a barrel of this type.

BACKGROUND OF THE INVENTION

Barrels for self-winding timepieces conventionally include a drum housing a mainspring coiled about a barrel arbour. To prevent any overwinding of the mainspring, which could cause it to give way or damage the gear train of the self-winding device, the mainspring is not fixed to the lateral wall of the drum, but friction coupled, via its last coil or turn, using an elastic strip called a slip spring. The friction coupling between the mainspring and the lateral wall of the drum must be calculated such that, beyond a defined maximum drive torque, the last coil slips along said wall and thus reduces the tension of the mainspring. The surface state of the internal lateral wall of the drum and the lubrication thereof are factors that greatly affect the operation of this friction coupling. Another determining factor concerns the geometry of the internal lateral wall.

According to the state of the art, the internal lateral wall of the drum includes friction surfaces, alternating with cut out portions in the form of notches in which the end of the mainspring abuts. The combined effects of friction and abutment of the last coil on the lateral wall enable high maximum drive torques to be attained and thus a large power reserve.

However, one difficulty linked to the presence of notches in the internal lateral wall of the drum is that of wear. The problem of wear is particularly inconvenient since it self-amplifies and may lead to significant damage, malfunctions or even to breakage of a part. When the friction of the last mainspring coil tears off fine particles from the wall, they make the friction more abrasive, which produces more particles and accelerates the process of wear. Over time, the friction coupling between the mainspring and the lateral wall of the barrel may be seriously affected.

It is known that the presence of notches in the internal lateral wall of the drum contributes to the process of barrel wear. Indeed, the notches form square salient edges at the upstream and downstream boundaries of the friction surfaces relative to the direction in which the last coil slips, i.e. respectively at the outlet and inlet of the notch. The mainspring pressure is very high at these square salient edges. They may therefore quickly become blunted.

According to a widespread prejudice among those skilled in the art, the square salient edges delimiting the friction surfaces upstream relative to the direction in which the last coil slips, are mainly responsible for generating, by wear, particles that accelerate the process of wear. Indeed, these edges play an active part in the friction coupling, since the end of the last coil abuts against the salient edges at the outlet of the notch, unlike the square salient edges at the inlet to the notch, which are virtually passive in the friction coupling.

Observations made within the scope of the present invention show that, contrary to commonly accepted belief, the square salient edges delimiting the friction surfaces downstream relative to the slip direction of the last coil, also play an important part as precursors, by wear, of the generation of particles accelerating the process of wear. The explanation for this is as follows: The slipping movement of the last coil against the friction surfaces is generally slow because of the permanent quasi-equilibrium between the drive torque and the friction torque. The end of the last mainspring coil thus arrives slowly at the notch inlet and rubs against the square salient edge which demarcates the downstream friction surface, at a low speed. At low speed, the lubrication efficiency is mediocre and there is significant friction. There is therefore significant wear of the square salient edge at the notch inlet. The situation is slightly different as regards the square salient edge which demarcates the friction surface upstream relative to the slip direction of the last coil. Indeed, the end of the last mainspring coil abuts against this square salient edge at the notch outlet, which substantially increases the mainspring tension up to the defined maximum drive torque. When the winding of the mainspring increases beyond this value, the end of the mainspring leaves the notch, abruptly breaking the quasi-equilibrium between the drive torque and the friction torque. The notch outlet then wears very quickly. At a high speed, lubrication efficiency is good, which greatly limits friction. Ultimately, the wear of the square salient edges both at the inlet and outlet of the notch play an important part in the degradation of the surface by wear, even if the inlet edges do not actively participate as stop members in the friction coupling between the last mainspring coil and the internal lateral drum wall.

SUMMARY OF THE INVENTION

The investigations carried out within the scope of the invention thus clearly show the existence of a little known problem of wear at the notch inlet, and an explanation is put forward to explain this phenomenon. It is an object of the present invention to overcome this problem of wear, by proposing a geometry for the internal lateral drum wall that has no passive square salient edges. More specifically, the invention concerns a barrel for a self-winding timepiece, including a drum of axis AA provided with an internal lateral wall having friction surfaces alternating with structures forming salient or inward edges at the boundary of the friction surfaces and a mainspring forming a winding having an external coil, which is friction coupled to the internal lateral wall and free to slip against the internal lateral wall in the event of overwinding of the mainspring. According to the invention, the friction surfaces are demarcated, downstream relative to the slip direction of the outer coil, by a rounded or inward edge.

Owing to the aforecited feature of the barrel according to the invention, the drum wear component that is not directly useful, i.e. concerning the passive square salient edges, is removed, and wear is limited to the active square salient edges. The phenomenon of self-perpetuating wear, and consequently general wear, are thereby reduced.

BRIEF DESCRIPTION OF THE DRAWINGS

Other features and advantages of the present invention will appear more clearly from the following detailed description of one embodiment of a barrel according to the invention, this example being given solely by way of non-limiting illustration with reference to the annexed drawing, in which.

DETAILED DESCRIPTION OF THE PREFERRED EMBODIMENTS

Figure 1:
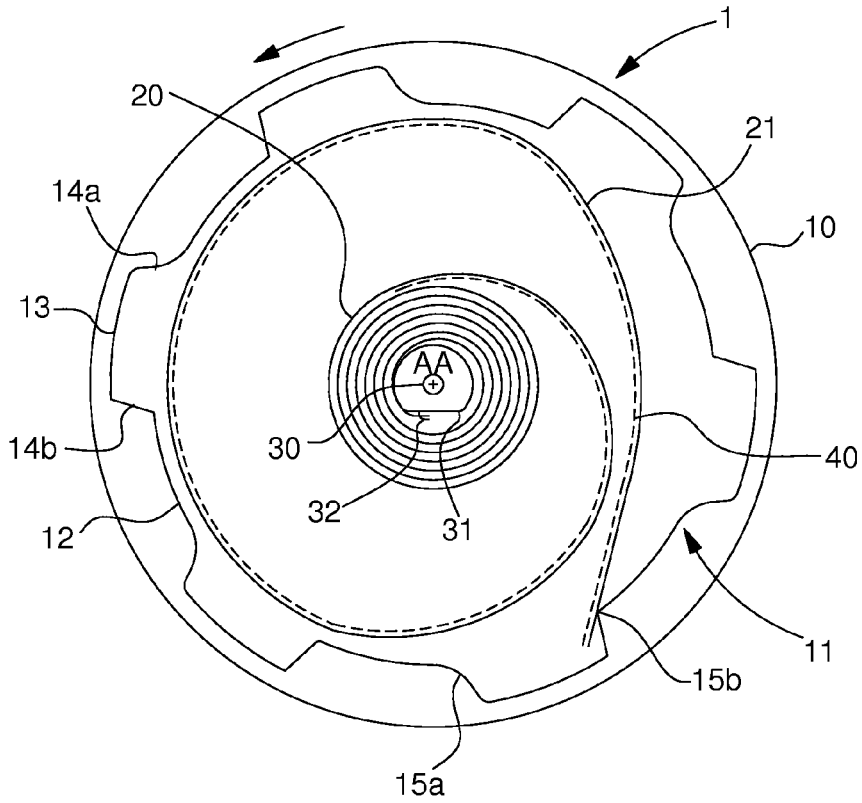
FIGS. 1 and 2 are schematic transverse cross-sections of first and second embodiments of a barrel according to the invention in a wound position.

The barrel for a self-winding timepiece shown in FIG. 1 and referenced as a whole 1 includes, in a conventional manner, a circular drum 10, of axis AA, provided with an internal lateral wall 11, which houses a mainspring 20 forming a spiral winding about a barrel arbour 30. Mainspring 20 is fixed by the inner end thereof to a core 31, secured in rotation to barrel arbour 30. Core 31 is provided with a hook 32 for this purpose.

To prevent any overwinding of mainspring 20 caused by self-winding, the outer end thereof is not fixed to internal lateral wall 11 of drum 10. Mainspring 20 includes an outer coil or turn 21, which is friction coupled to internal lateral wall 11. For this purpose, an elastic strip 40, called a slip spring, is fixed to the outer end of mainspring 20, by welding, riveting or any other method known to those skilled in the art. Inserted between outer coil 21 and the penultimate coil of mainspring 20, slip spring 40 exerts stress on outer coil 21 which tends to press the latter against internal lateral wall 11 of drum 10. In a variant, slip spring 40 is inserted between internal lateral wall 11 of drum 10 and the outer coil 21 of mainspring 20, and is in turn pressed against said wall. The friction coupling thereby achieved between mainspring 20 and drum 10 allows mainspring 20 to be wound up to a defined maximum limit. Beyond this limit value, outer coil 21 slips against wall 11, thereby reducing the tension and the risk of breaking mainspring 20.

Internal lateral wall 11 of drum 10 includes friction surfaces 12 alternating with locking structures in the form of notches 13. Friction surfaces 12 extend circularly relative to axis AA of drum 10. Notches 13 include two flanks 14*a* and 14*b* respectively at the notch inlet and outlet, which intersect friction surfaces 12. It is specified that the inlet and outlet of notches 13 are defined in relation to the slip direction of outer coil 21 of mainspring 20 against wall 11, indicated by an arrow in FIGS. 1 and 2. When the outer coil 21 of mainspring 20 slips against wall 11, the end thereof thus enters a notch 13 by flank 14*a* and exits by flank 14*b*.

Flanks 14*b* at the outlet of notches 13 are active in the friction coupling between mainspring 20 and drum 10. They are intended to stop the slipping movement of the end of mainspring 20 along internal lateral wall 11 by forming locking surfaces against which the end of mainspring 20 will abut. The slanting of flanks 14*b* is optimised for this purpose. Flanks 14*b* at the outlet of notches 13 intersect friction surfaces 12 upstream relative to the slip direction of outer coil 21, by forming a salient edge or acute angle 15*b*, the function of which is also to stop the sliding of mainspring 20. Salient edges 15*b* are preferably square edges since they act on the sliding of mainspring 20 by the effect of friction, and the friction is higher the more square the edge. "Square edge" means an edge with a zero or low radius of curvature. By way of illustration, the radius of curvature of an edge of this type is comprised between 0.02 and 0.1 mm. Salient edge 15*b*, which demarcates friction surfaces 12 may, in a variant, be slightly rounded. The effect it has on stopping the slipping movement of mainspring 20 is then substantially reduced, because of the decrease in friction.

Unlike flanks 14*b* at the outlet of notches 13, flanks 14*a* at the inlet of notches 13 are passive in the friction coupling between mainspring 20 and drum 10. They intersect friction surfaces 12 downstream relative to the slip direction of outer coil 21 and form a salient edge 15*a*. According to the invention, salient edges 15*a* are rounded. "Rounded edge" means an edge with a high radius of curvature compared to the square edge. By way of illustration, edges 15*a* at the inlet of notches 13 have a radius of curvature higher than 0.15 mm. This feature of barrel 1 according to the invention reduces the general wear of internal lateral wall 11 and of mainspring 20.

Indeed, the friction of mainspring 20 and in particular the end thereof is low on these rounded edges 15*a* compared to the friction on square edges 15*b*, since the contact pressure is lower. The wear of edges 15*a* at the inlet of notches 13 and the phenomenon of self-perpetuating wear are thereby reduced. The increase in the radius of curvature of the edge also allows better lubrication distribution by preventing any non-functional deposit from forming in the corner formed by the notch inlet flank 14*a* and the bottom of notch 13. Note that the friction coupling between mainspring 20 and internal lateral wall 11 is not affected by the rounded profile of edges 15*a* at the inlet of notches 13, since the latter are passive in the friction coupling. Long term, the effect is even positive since the reduction in wear of mainspring 20 and internal lateral wall 11 slows down degradation of the friction coupling over time. The longevity of barrel 1 is thereby increased.

Figure 2:
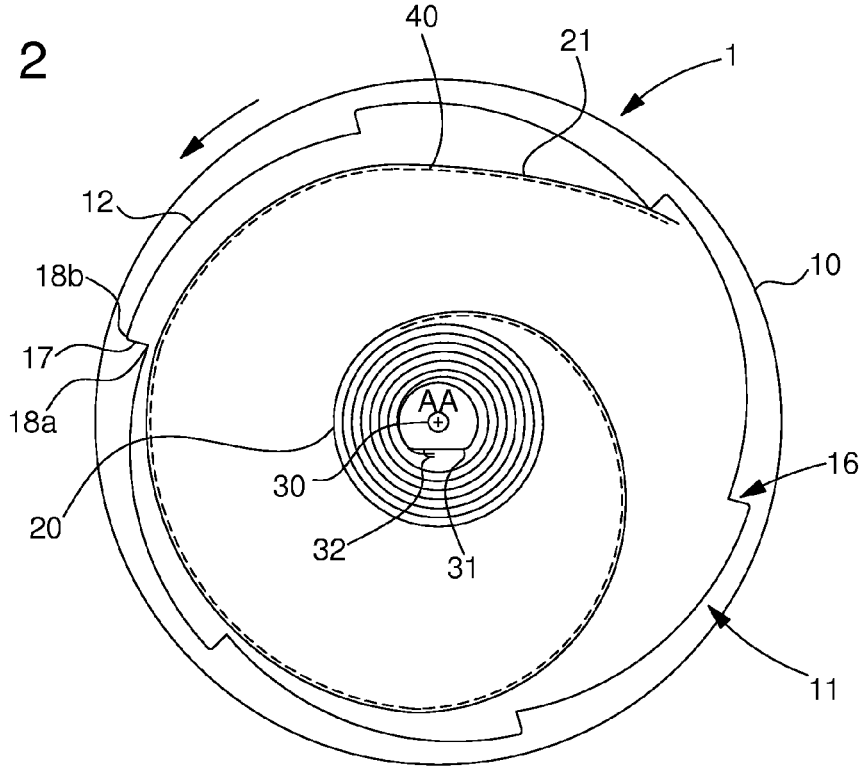

Reference is now made to FIG. 2 which shows a second embodiment of the barrel according to the invention. The difference between the barrel for a self-winding timepiece shown in FIG. 2 and referenced 1 as a whole and the previously described barrel lies in the geometry of the internal lateral wall 11 of drum 10.

As previously, internal lateral wall 11 includes friction surfaces 12 alternating with locking structures. These structures form steps 16 and not notches 13, including a flank 17. Friction surfaces 12 extend slightly in a spiral relative to axis AA of drum 10. Flanks 17 intersect friction surfaces 12 to form a salient edge 18*a*, which demarcates said surfaces upstream relative to the slip direction of outer coil 21, and an inward edge 18*b* or re-entrant angle which demarcates them on the downstream side. Flanks 17 and salient edges 18*a* are active in the friction coupling between mainspring 20 and drum 10. For this reason, and as explained previously, the salient edges 18*a* are preferably square edges or acute angles, but may also, in a variant, be slightly rounded.

However, in this embodiment, the salient edges which are passive as regards the friction coupling between mainspring 20 and internal lateral wall 11 of drum 10 are totally absent. Friction surfaces 12 are demarcated on the downstream side relative to the slip direction of outer coil 21, by an inward edge 18*b* which may be square or rounded and which has no function in the friction coupling. This embodiment represents an extreme case of the embodiment described above, wherein the salient edges 15*a* at the inlet of notch 13 have an infinite radius of curvature and the inlet of notch 13 is completely omitted. The barrel 1 thus described has the same advantages of reduced wear and increased longevity as the barrel 1 described with reference to FIG. 1.

Thus, a barrel for a self-winding timepiece has been described, whose reduced geometry is devised to decrease wear. Of course, it goes without saying that the barrel according to the invention is not limited to the embodiment that has just been described and that various simple alterations and variants can be envisaged by those skilled in the art without departing from the scope of the invention as defined by the annexed claims.

What is claimed is:

1. A barrel for a self-winding timepiece including a drum of axis AA provided with an internal lateral wall having friction surfaces alternating with locking structures forming salient edges at the boundary of the friction surfaces and a mainspring forming a winding including an outer coil, which is friction coupled to said internal lateral wall and free to slip against said internal lateral wall in the event of overwinding of the mainspring, characterized in that said structures form notches including a flank at the inlet thereof that intersects the friction surfaces downstream relative to the direction in which said outer coil slips, forming a rounded salient edge, and in that said salient edge has a radius of curvature of more than 0.15 mm and in that said notches include a flank at the outlet thereof that intersects said friction surfaces upstream relative to the direction in which said outer coil slips, forming a salient edge whose radius of curvature is zero or comprised between 0.002 and 0.1 mm.

2. The barrel according to claim 1, characterized in that said friction surfaces extend circularly relative to the axis AA of the drum.

3. A barrel for a self-winding timepiece including a drum of axis AA provided with an internal lateral wall having friction surfaces alternating with locking structures forming inward edges at the boundary of the friction surfaces and a mainspring forming a winding including an outer coil, which is friction coupled to said internal lateral wall and free to slip against said internal lateral wall in the event of overwinding of the mainspring, characterized in that said structures form steps including a flank that intersects said friction surfaces downstream relative to the direction in which said outer coil slips, forming an inward edge.

4. The barrel according to claim 3, characterized in that said friction surfaces extend in a spiral relative to the axis AA of the drum.

5. The barrel according to claim 3, characterized in that said flank intersects said friction surfaces upstream relative to the slip direction of said outer coil to form a salient edge.

6. A timepiece provided with a self-winding movement powered by a barrel including a drum of axis AA provided with an internal lateral wall having friction surfaces alternating with locking structures forming salient edges at the boundary of the friction surfaces and a mainspring forming a winding including an outer coil, which is friction coupled to said internal lateral wall and free to slip against said internal lateral wall in the event of overwinding of the mainspring, characterized in that said structures form notches including a flank at the inlet thereof that intersects the friction surfaces downstream relative to the direction in which said outer coil slips, forming a rounded salient edge, and in that said salient edge has a radius of curvature of more than 0.15 mm and in that said notches include a flank at the outlet thereof that intersects said friction surfaces upstream relative to the direction in which said outer coil slips, forming a salient edge whose radius of curvature is zero or comprised between 0.002 and 0.1 mm.

* * * * *